US011918035B2

(12) United States Patent
Clarke et al.

(10) Patent No.: US 11,918,035 B2
(45) Date of Patent: Mar. 5, 2024

(54) TOBACCO SMOKE FILTER

(71) Applicant: Filtrona Filter Products Development Co. Pte. Ltd., Singapore (SG)

(72) Inventors: Paul Francis Clarke, Morpeth (GB); Ahmad Fashihul Lisan, Sidoarjo (ID)

(73) Assignee: Filtrona Filter Products Development Co. Pte. Ltd., Singapore (SG)

( * ) Notice: Subject to any disclaimer, the term of this patent is extended or adjusted under 35 U.S.C. 154(b) by 987 days.

(21) Appl. No.: 16/553,711

(22) Filed: Aug. 28, 2019

(65) Prior Publication Data

US 2020/0015515 A1 Jan. 16, 2020

Related U.S. Application Data

(63) Continuation of application No. 13/701,706, filed as application No. PCT/GB2011/000864 on Jun. 8, 2011, now abandoned.

(30) Foreign Application Priority Data

Jun. 10, 2010 (GB) ..... 1009738
Dec. 20, 2010 (GB) ..... 1021756

(51) Int. Cl.
*A24D 3/04* (2006.01)
*A24D 3/18* (2006.01)
*A24F 13/06* (2006.01)

(52) U.S. Cl.
CPC ..... *A24D 3/04* (2013.01); *A24D 3/18* (2013.01); *A24F 13/06* (2013.01)

(58) Field of Classification Search
None
See application file for complete search history.

(56) References Cited

U.S. PATENT DOCUMENTS

| | | | |
|---|---|---|---|
| 3,064,541 | A | 11/1962 | Mantchev |
| 4,979,521 | A | 12/1990 | Davis et al. |
| 5,119,836 | A | 6/1992 | White |
| 5,685,323 | A | 11/1997 | Crooks et al. |
| 5,724,997 | A | 3/1998 | Smith et al. |
| 6,779,531 | B1 | 8/2004 | Biggs et al. |
| 7,243,659 | B1 | 7/2007 | Lecoultre et al. |
| 2010/0108085 | A1 | 5/2010 | Duke |
| 2010/0154808 | A1 | 6/2010 | Boll et al. |

(Continued)

FOREIGN PATENT DOCUMENTS

| | | |
|---|---|---|
| DE | 667048 | 11/1938 |
| DE | 4035421 A1 | 5/1992 |

(Continued)

OTHER PUBLICATIONS

Great Britain Patent Office Search Report issued in Great Britain Application No. 1009738.4, in English, dated Sep. 21, 2010 (1 page).

(Continued)

*Primary Examiner* — Dionne W. Mayes
(74) *Attorney, Agent, or Firm* — Flynn Thiel, P.C.

(57) ABSTRACT

A stand alone tobacco smoke filter or filter element for use with a smoking article comprising a wrapper engaged around a longitudinally extending core of tobacco smoke filtering material, wherein at least one end of the wrapper extends beyond the end of the core around which it is engaged, to define a cavity at the end of the filter which faces the smoking article in use.

5 Claims, 2 Drawing Sheets

(56) References Cited

U.S. PATENT DOCUMENTS

| | | | |
|---|---|---|---|
| 2010/0242977 | A1 | 9/2010 | Tarora et al. |
| 2015/0296878 | A1 | 10/2015 | Mucalo et al. |

FOREIGN PATENT DOCUMENTS

| | | | |
|---|---|---|---|
| DE | 19645563 | A1 | 5/1998 |
| EP | 0054718 | A1 | 6/1982 |
| EP | 1688052 | A1 | 8/2006 |
| EP | 1859694 | A1 | 11/2007 |
| FR | 798017 | A | 5/1936 |
| FR | 1115692 | A | 4/1956 |
| GB | 2026842 | A | 2/1980 |
| GB | 2261152 | A | 5/1993 |
| WO | 2006059134 | A1 | 6/2006 |
| WO | 2008132963 | A1 | 11/2008 |
| WO | 2009078287 | A1 | 6/2009 |

OTHER PUBLICATIONS

Notification of Transmittal of International Search Report and Written Opinion of International Searching Authority issued in International Application No. PCT/GB2011/000864, in English, dated Sep. 27, 2011 (1 page).

International Search Report issued in International Application No. PCT/GB2011/000864, in English, dated Sep. 27, 2011 (5 pages).

Written Opinion of the International Searching Authority issued in International Application No. PCT/GB2011/000864, in English, dated Sep. 27, 2011 (5 pages).

TOBACCO SMOKE FILTER

CROSS-REFERENCE TO RELATED APPLICATIONS

This is a continuation of prior U.S. application Ser. No. 13/701,706, filed Jan. 28, 2013, which is a National Phase application of PCT Application No. PCT/GB2011/000864, filed Jun. 8, 2011, which claims priority from British Application No. 1009738.4 filed on Jun. 10, 2010 and British Application No. 1021756.0 filed on Dec. 20, 2010, the contents of all of which are hereby incorporated herein in their entireties.

FIELD OF THE INVENTION

The present invention relates to filters and filter elements for use with non-filtered smoking articles, e.g. those of tapered shape.

BACKGROUND AND SUMMARY OF THE INVENTION

Non-filtered smoking articles with a tapered shape are known, with two well-known examples being kreteks (originating from Indonesia) and bidis (originating from India). Such smoking articles are normally prepared by hand. The present invention is suitable for use with such smoking articles as well as with cigars (which may be of tapered or untapered shape), and untapered plain (non-filtered) cigarettes.

It is desirable to be able to attach a filter to such non-filtered smoking articles in order to reduce the intake of toxic smoke compounds by the smoker. However, this may be difficult to achieve in practice, for example due to the unusual shape of these smoking articles and/or variations in size due to e.g. their method of hand assembly.

Recess filters are well known in the tobacco industry and provide a unique mouth or buccal end appearance for machine-made cigarettes. These filters are typically manufactured by wrapping a continuous stream of filter segments at spaced intervals in a relatively stiff plug wrap paper. By cutting the filter stream in a region where no filter element is present, an open tubular section can be obtained which then becomes the mouth end of the final filter cigarette. The stiff plugwrap paper is capable of providing sufficient rigidity to enable the final cigarette to be manufactured and used without crushing the exposed paper at the mouth end of the filter. During the cigarette manufacturing operation, a tipping overwrap is applied to join the recess filter to the tobacco column.

According to the present invention there is provided a (stand alone) tobacco smoke filter (or filter element) for use with a smoking article comprising a wrapper engaged around a longitudinally extending (e.g. cylindrical) core of tobacco smoke filtering material, wherein at least one end of the wrapper extends beyond the end of the core around which it is engaged, to define a (e.g. tubular) cavity at the end of the filter which faces (connects with) the smoking article in use.

The other end of the wrapper may be flush or substantially flush with the other end of the core (e.g. so the filter or filter element has a cavity at one end—i.e. the end which faces and engages (connects with) the smoking article in use).

In a preferred example, the wrapper extends beyond the end of the core around which it is engaged at both ends, to define a (e.g. tubular) cavity at each end of the filter, i.e. to define a first (e.g. tubular) cavity at the end of the filter which faces and engages (connects with) the smoking article in use, and a second cavity at the other (mouth or buccal) end.

The radially inner face of the wrapper which extends beyond the end of the core around which it is engaged may define (e.g. with the end of the longitudinally extending core) a cavity or recess, usually a tubular cavity/recess, at that end of the filter.

The recess (cavity) section of the filter or filter element (that is, the length by which the or each end of the wrapper extends beyond the end of the core around which is engaged to define the cavity at the end of the filter) may have a length 3 to 14 mm, and is most preferably of length 5 to 12 mm, for example 5, 6, 7, 8, 9, 10, 11 or 12 mm. Thus, the recess (cavity) section of the filter or filter element (that is, the length by which the or each end of the wrapper extends beyond the end of the core around which is engaged to define the cavity at the end of the filter) may be of length sufficient to provide a good interference fit between the radially inner face of the wrapper which defines the cavity, and the outer face of the tapered smoking article (without the inserted end of the article interfering with the end of the core to prevent the fit). The tobacco smoke filter or filter element may be of length 10 to 40 mm, e.g. 15 to 35 mm, e.g. 20 to 30 mm. The longitudinally extending core of tobacco smoke filtering material may be of length 7 to 30 mm, e.g. 10 to 30 mm e.g. 14 to 27 mm, e.g. 17 to 25 mm. The tobacco smoke filter or filter element may be of circumference 14 to 28 mm, for example 16 to 26 mm, for example 16 to 17 mm or 24 to 25 mm.

The applicants have developed a stand-alone filter (tip) that can be easily connected by the smoker to a smoking article, for example a tapered smoking article. The smoker inserts one end (e.g. the narrower end) of his smoking article (e.g. bidi or kretek) into the (e.g. tubular) cavity at the end of the filter. A slight twisting or screwing action between the tip and the smoking article may be required to achieve the best fit. The diameter of the cavity is slightly greater than the diameter of the narrower end of the smoking article to allow for ease of insertion of the smoking article and a snug interference fit between the smoking article and the filter tip. The snug interference fit may eliminate the need for any gluing between these two items, as is associated with the manufacture of conventional machine-made cigarettes.

In another example, the wrapper has an adhesive, for example a contact adhesive, applied thereto. The (e.g. contact) adhesive may be applied to the radially inner face of the wrapper which extends beyond the end of the core around which it is engaged. For example, the (or each) radially inner face of the wrapper which extends beyond the end of the core around which it is engaged to define the e.g. tubular cavity or recess at that (or each) end of the filter may have an adhesive, for example a contact adhesive, applied thereto. The smoker inserts the end of the smoking article (bidi, kretek, tapered or untapered cigar, cigarette) into the (tubular) cavity or recess at the (or one) end of the filter tip, and the article is held in place by the adhesive (e.g. on the radially inner face of the wrapper), a snug interference fit between the smoking article and the filter tip, or a combination of both. Again, a slight twisting or screwing action between the tip and the smoking article may be required to achieve the best fit and/or activate the adhesive. It will be appreciated that the use of an adhesive may be required to hold e.g. a non-tapered smoking article in place, for example the interference fit between the untapered article and the inner face of the recess alone is insufficient. Adhesive may be applied to the (e.g. inner face of the) wrapper by methods well known in the art. The adhesive may be applied to the whole inner face of the wrapper, or to portions thereof (e.g. applied substantially only to the portions which are to extend beyond the end of the core to define the cavity or recess).

Herein the term "stand-alone" or "stand alone" means a single discrete filter or filter element which is not connected to a smoking article, but is made and sold for use with hand-rolled or otherwise prepared smoking articles.

As indicated above the filter may have a cavity/recess of length 3 to 14 mm, most preferably of length 5 to 12 mm, for example 5, 6, 7, 8, 9, 10, 11 or 12 mm, at each end, effectively comprising a (e.g. paper) tube at either end with a filter section centrally located. The smoker can then insert the smoking article into either end of the filter, making it easier for him to use in practice. A further advantage of this example is that as the continuously formed filter would only need to be cut through an open tube section, variations in pressure drop caused by movements in the position of the cut along the length of the filter segment section can be avoided.

The wrapper may be paper, e.g. plugwrap paper, e.g. stiff plugwrap paper. The outer wrapper may be porous or non porous. The outer wrapper may be a paper of basis weight from about 30 to about 120 g/m$^2$. The outer wrapper may be of basis weight from about 80 to about 120 g/m$^2$, for example a basis weight of around 100 g/m$^2$, e.g. for use with a recess filter of standard (c. 24-25 mm) circumference—e.g. for use with a Kretek smoking article. The outer wrapper may be a plugwrap paper of a lower basis weight, e.g. around 50 g/m$^2$—for example for use with a narrower smoking articles, e.g. a bidi—i.e. of circumference less than 23 mm (e.g. down to around 16-17 mm circumference).

The wrapper, for example plugwrap paper, may be printed or coated (e.g. on its radially outer surface) with pattern, e.g. a cork effect on its outer surface. The pattern may resemble the filter tip of a machine made cigarette. This overcomes the less aesthetically pleasing appearance associated with plugwrap paper. In another example, the wrapper may include a distinctive pattern (e.g. on its radially outer surface), which may enhance brand identity.

Preferably the wrapper is hydrophobic, e.g. on its outer surface, e.g. has a hydrophobic coating. The hydrophobic wrapper should prevent (or reduce incidence of) the smokers' lips from sticking to the filter (tip).

The use of a hydrophobic wrapper may negate the need for a further tipping overwrap (although it will be appreciated that the filter or filter element may include a tipping overwrap).

The filter or filter element may include a further wrapper, for example a tipping paper. It will be appreciated that where the tip is double wrapped (e.g. with both a plugwrap paper and a tipping paper), the desired rigidity or stiffness can be achieved through the combination of these two wrappers.

The filter or filter element may contain perforations around its periphery to allow the ingress of air to dilute the concentration of smoke.

The filtering material may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and synthetic non-wovens, and extruded material (e.g. starch, synthetic foams). Preferably, the filtering material is a cellulose acetate tow.

The longitudinally extending (e.g. cylindrical) core of tobacco smoke filtering material may include one or more segments or sections of filtering material. Preferably the longitudinally extending (e.g. cylindrical) core of tobacco smoke filtering material includes a single section of filtering material. The (or each) filter section could also be of any special design commonly known, e.g. 'Active Patch', 'Smooth Core', 'Flavour Thread' or 'CPA' filters all of which are available from Filtrona Filters. For example, in the event that a CPA filter section with the flutes at one end only is used, the exposed flutes of the filter could either be at the mouth end of the filter (thereby giving a more unusual mouth end appearance) or facing the paper tube end (in which case a more conventional mouth-end appearance would be obtained). It will be appreciated that if a CPA filter section with the flutes at one end only is used, and the filter has a recess at only one end, the unusual appearance will only be provided in use if the flute is at the mouth (non recess) end. However, if the filter has a recess at each end (and the CPA filter section has flutes at one end only) the smoker has the option of choosing whether to have the flutes at the mouth end (for a distinctive mouth end appearance) or the smoking article end (more conventional mouth end appearance).

The present applicant has found that e.g. 'monocarbon' filters—i.e. filters incorporating a single longitudinally extending core of filtering material and additive (e.g. carbon) that have at least one end free of additive and e.g. which can be manufactured in a one-pass process (including the 'Active Patch' filter, as disclosed in, for example, GB 2261152, and the 'Smooth Core' filter, as disclosed in, for example, WO 2006/059134)—may effectively and advantageously be incorporated into a filter tip, according to aspects of the present invention. The claimed filters (recess filter tips), especially those having a recess at each end, may provide improved sensory characteristics, because it is possible to exercise greater control over the contact of the smoke stream with the carbon in the filter (e.g. by controlling the location of the carbon within a central 'pod' or pocket in a 'Smooth Core' filter, or on the periphery of the plugwrap in an 'Active Patch' filter) and then allowing the smoke streams to circulate and mingle within the mouth end recess prior to entering the smoker's mouth and impinging on their palate. The use, as a "base rod" within a filter of the invention, of a single longitudinally extending core of filtering material having at least one additive-free end, can offer greater design flexibility for the product, and allows the provision of a carbon containing filter without requirement for a multiple segment filter.

The filter or filter element may contain a flavouring agent (e.g. menthol). The flavour may modify or enhance the smoking experience.

The filters (filter tips) and filter elements are easily assembled using conventional filter-making machinery and processes for the manufacture of recess filter rods for machine-made recess filter cigarettes. The invention includes multiple length filter rods that are subsequently cut down into individual tips.

According to the present invention in a further aspect there is provided a stand-alone tobacco smoke filter or filter element for use with a smoking article, the filter or filter element comprising a longitudinally extending (e.g. cylindrical) core of tobacco smoke filtering material and a wrapper which is attached thereto; the wrapper being engageable around the longitudinally extending core of tobacco smoke filtering material and at least a part of a smoking article placed adjacent (longitudinally) thereto and in register therewith; the wrapper comprising fixing means (e.g. adhesive, e.g. contact adhesive or adhesive which is activated by liquid e.g. saliva) for fixing the wrapper in place when it is engaged around the longitudinally extending core of tobacco smoke filtering material and the part of the smoking article placed adjacent thereto, to thereby hold the core of tobacco smoke filtering material in register with the smoking article.

The applicants have found that provision of a filter element as set out above wherein the wrapper is fixed in place by the user may provide a particularly tight seal between the filter element and the smoking article.

The wrapper may be attached to the core along at least a part of a longitudinal edge of the wrapper.

In an example, the wrapper is longer that the core in the longitudinal direction of the core. One end of the wrapper may be flush or substantially flush with one end of the core, while the other end of the wrapper extends beyond the end of the core; the end of the wrapper which extends beyond the end of the core is the part of the wrapper which engages around the smoking article in use. The wrapper is attached to the core e.g. with adhesive e.g. along the portion of the longitudinal edge which is in contact with the core. The wrapper has (further) fixing means e.g. adhesive e.g. contact adhesive—for example along the other longitudinal edge—e.g. along the edge which is opposite to the edge which is attached to the core. The further fixing means may for example be on the radially inner face of the wrapper. In use, the smoker places one end of a smoking article (bidi, kretek, unfiltered cigarette) in register with the end of the core which has the overlapping wrapper. The wrapper is then engaged (wrapped) around both the longitudinally extending core of tobacco smoke filtering material and the part of the smoking article which is adjacent (longitudinally) thereto and in register therewith. The fixing means (e.g. adhesive, e.g. contact adhesive or adhesive which is activated by liquid e.g. saliva) on the radially inner face of the wrapper is then fixed to the radially outer face of the smoking article and the core (or wrapper) to hold the core of tobacco smoke filtering material and the part of the smoking article placed adjacent thereto (and in register therewith) together, thereby providing a filtered smoking article.

The wrapper may be paper, e.g. plugwrap paper, e.g. stiff plugwrap paper. The wrapper may be porous or non porous. The wrapper may be a paper of basis weight from about 30 to about 120 g/m$^2$. The outer wrapper may be of basis weight from about 80 to about 120 g/m$^2$, for example a basis weight of around 100 g/m$^2$, e.g. for use with a recess filter of standard (c. 24-25 mm) circumference—e.g. for use with a Kretek smoking article. The outer wrapper may be a plugwrap paper of a lower basis weight, e.g. around 50 g/m$^2$—for example for use with a narrower smoking articles, e.g. a bidi—i.e. of circumference less than 23 mm (e.g. down to around 16-17 mm circumference).

The wrapper, for example plugwrap paper, may be printed or coated (e.g. on its radially outer surface) with pattern, e.g. a cork effect on its outer surface. The pattern may resemble the filter tip of a machine made cigarette. This overcomes the less aesthetically pleasing appearance associated with plugwrap paper. In another example, the wrapper may include a distinctive pattern (e.g. on its radially outer surface), which may enhance brand identity.

Preferably the wrapper is hydrophobic, e.g. on its outer surface, e.g. has a hydrophobic coating. The hydrophobic wrapper should prevent (or reduce incidence of) the smokers' lips from sticking to the filter (tip).

BRIEF DESCRIPTION OF THE DRAWINGS

The present invention will now be illustrated with reference to the following Examples and the attached drawings.

DETAILED DESCRIPTION

Figure 1:
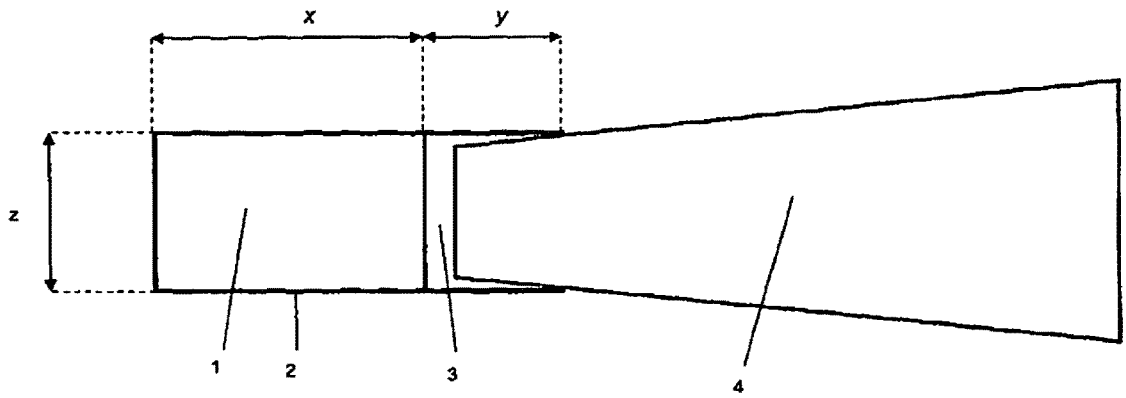
FIG. 1 schematically illustrates a recess filter according to an example of the invention in use.

FIG. 1 shows an assembled cigarette, not to scale, incorporating a filter according to an example of the invention. The filter tip comprises a cylindrical plug 1 of cellulose acetate wrapped in a plugwrap (not shown) of 27 g/m$^2$ weight. The length of this plug (dimension x) is 18 mm. The tip is overwrapped in a stiff plugwrap 2 of 100 g/m$^2$ weight that extends beyond one end of the core around which it is engaged, to define a tubular cavity, or hollow tube 3, at that end of the filter. The stiff plugwrap has been printed on its outer surface with a cork effect. The length of hollow tube 3 (dimension y) is 9 mm, which corresponds to the length of the recess, thereby giving an overall tip length of 27 mm. The internal diameter of the tube 3 (dimension z) is 8 mm, corresponding to a circumference of 25 mm. A non-filtered tapered kretek cigarette 4 is inserted into the tube. The outer circumference of the kretek at around 7 mm from its narrower end is around 25 mm. Thus, a good interference fit between the tip and the kretek is achieved.

Figure 2:
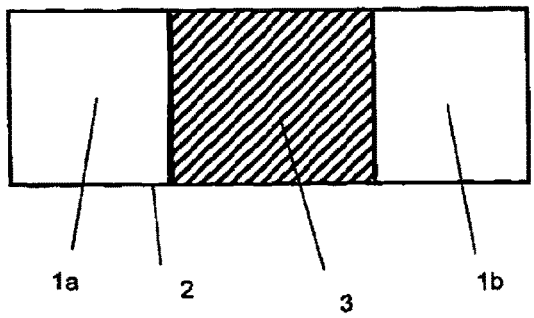
FIG. 2 schematically illustrates a recess filter according to another example of the invention.

FIG. 2 shows a filter tip according to a further example of the invention. The filter tip comprises a plug 3 of cellulose acetate wrapped in a plugwrap (not shown) of 27 g/m$^2$ weight. The length of this plug is 11 mm. The tip is overwrapped in a stiff plugwrap 2 of 100 g/m$^2$ weight that extends beyond the plug in both directions to form hollow tubes 1*a* and 1*b* each of length 8 mm. The stiff plugwrap has been printed on its outer surface with a cork effect. The overall tip length is 27 mm and the internal diameter of each tubular section (recess) is 8 mm. The smoker is able to insert a non-filtered tapered smoking article, e.g. kretek, into either end of the tip, corresponding to a circumference of 25 mm.

In the example tips shown in FIGS. 1 and 2, the (or each) radially inner face of the plugwrap 2 which extends beyond the end of the plug around which it is engaged to form the hollow tubes (3 in FIG. 1, 1*a*, 1*b* in FIG. 2) may optionally have an adhesive, for example a contact adhesive, applied thereto. It will be appreciated that the use of an adhesive may be required to hold e.g. a non-tapered smoking article in place, if the interference fit between the untapered article and the inner face of the recess alone is insufficient. Adhesive may be applied to the (e.g. inner face of the) wrapper by methods well known in the art.

Figure 3:
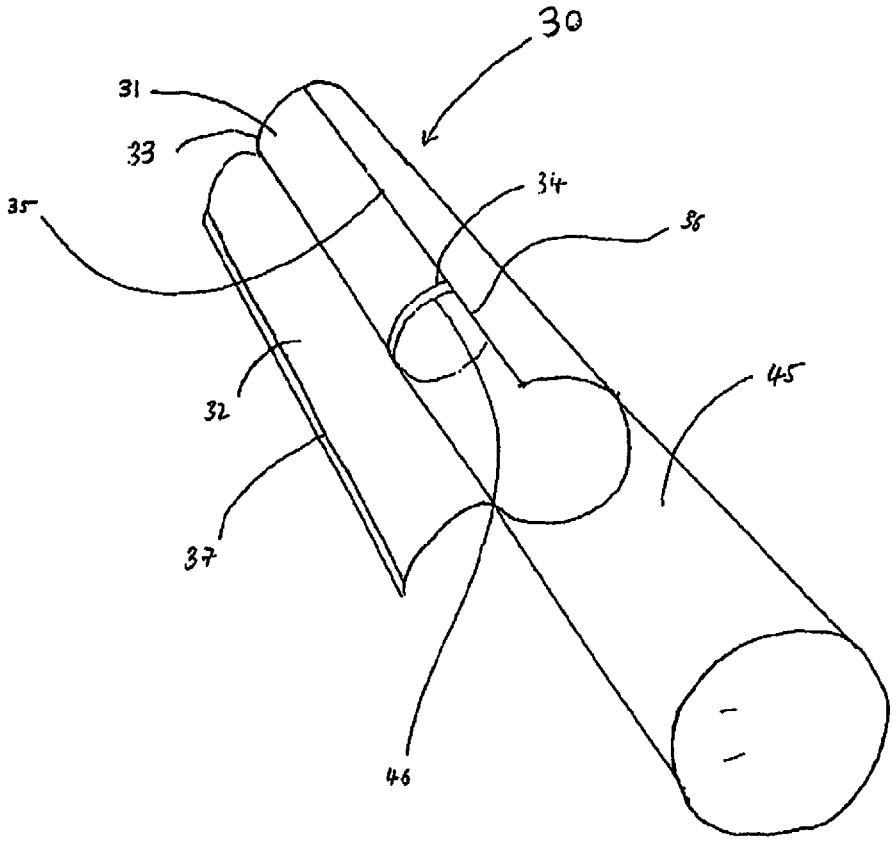
FIG. 3 illustrates a stand-alone filter according to a further example of the invention and its use.

FIG. 3 shows filter tip 30 according to a still further example of the invention. The filter tip 30 comprises a core in the form of a cylindrical plug 31 of cellulose acetate attached to a wrapper 32 formed of a sheet of plugwrap of 45 g/m$^2$ weight. As seen in FIG. 3, the wrapper 32 is a rectangle of plugwrap which is longer that the plug 31 in the longitudinal direction of the plug. One end of the wrapper 32 is substantially flush with one end 33 of the plug 31, while the other end of the wrapper 32 extends beyond the other end 34 of plug 31. The wrapper is attached to the plug 31 with adhesive along the portion 35 of the longitudinal edge 36 which is in contact with the plug 31; the wrapper has (further) fixing means in the form of gum along its other longitudinal edge 37 (along the edge which is opposite to the edge 36 which is attached to the core). It will be appreciated that for storage, packaging and sale etc the wrapper 32 may be wrapped or furled around the plug 31, but not fixed in engagement around the plug (i.e. the adhesive is not activated).

The filter tip 30 is used as shown in FIG. 3. The smoker takes the stand-alone filter tip 30 and unfurls the wrapper 32 from around the plug 31. He then places one end 46 of a smoking article (bidi, kretek, unfiltered cigarette) 45 adjacent to and in register with the end 34 of the plug 31 which has the overlapping wrapper. It will be appreciated that in general the end 46 of smoking article 45 will be butted up to and in contact with end 34 of plug 31. The wrapper 32 is then engaged (wrapped) around both plug 31 and the adjacent part of the smoking article 45 so as to encircle and surround both the plug and the end section of article 45. The fixing means (gum) on the inner face of edge 37 of the wrapper 32 is then fixed (stuck) to the radially outer face of the smoking article 45 and the plug 1 (or wrapper 32) to hold the wrapper 32 in engagement around plug 32 and smoking article 45, thereby providing a filtered smoking article.

It will be appreciated that the filters of the invention may be made by methods known in the art.

The invention claimed is:

1. A method of forming a filtered smoking product, the method comprising:

providing a longitudinally extending core of tobacco smoke filtering material having a wrapper circumscribed around the longitudinally extending core of tobacco smoke filtering material;

providing a smoking article;

unfurling the wrapper from around the longitudinally extending core of tobacco smoke filtering material and placing an end of the smoking article adjacent to an end of the longitudinally extending core of tobacco smoke filtering material;

re-engaging the wrapper so as to fully encircle and surround both the longitudinally extending core of tobacco smoke filtering material and the end of the smoking article adjacent to the end of the longitudinally extending core of tobacco smoke filtering material; and fixing the wrapper via fixing means to the end of the smoking article adjacent to the end of the longitudinally extending core of tobacco smoke filtering material to thereby hold the wrapper in place around the longitudinally extending core of tobacco smoke filtering material in register with the smoking article to thereby form the filtered smoking product;

wherein the wrapper is paper of basis weight from 30 to 80 $g/m^2$; and wherein the smoking article has a circumference of 16 to 17 MM.

2. The method according to claim 1, wherein the longitudinally extending core of tobacco smoke filtering material contains a flavoring agent.

3. The method according to claim 1, wherein the smoking article is a kretek cigarette.

4. The method according to claim 1, wherein the wrapper is a single wrapper.

5. The method according to claim 1, wherein the paper is of basis weight of about 50 $g/m^2$.

* * * * *